United States Patent [19]

Gardner et al.

[11] Patent Number: 4,598,183

[45] Date of Patent: Jul. 1, 1986

[54] TRIP INDICATING CIRCUIT BREAKER OPERATING HANDLE

[75] Inventors: Jeffrey B. Gardner; Gerald J. Kuiper, both of Columbia, S.C.; Richard A. Nelson, Winston-Salem, N.C.

[73] Assignee: Square D Company, Palatine, Ill.

[21] Appl. No.: 634,947

[22] Filed: Jul. 27, 1984

[51] Int. Cl.[4] ..... H01H 9/20

[52] U.S. Cl. ..... 200/50 A; 200/330

[58] Field of Search ..... 200/50 A, 330, 337, 200/153 G; 361/337, 339, 343, 344

[56] References Cited

U.S. PATENT DOCUMENTS

| | | | |
|---|---|---|---|
| 2,695,934 | 11/1954 | Wills | 200/330 X |
| 2,806,098 | 9/1957 | Purtman et al. | 200/50 A |
| 2,890,302 | 6/1959 | DeBenedictis | 200/50 A |
| 3,059,072 | 10/1962 | Mekelburg et al. | 200/50 A |
| 3,207,880 | 9/1965 | Mekelburg | 200/330 |
| 3,229,056 | 1/1966 | Turnbull | 200/50 A |
| 3,324,259 | 6/1967 | Chamberlin, Jr. et al. | 200/50 A |
| 3,382,331 | 5/1968 | Jencks et al. | 200/50 A |
| 3,475,576 | 10/1969 | Bugni et al. | 200/330 |
| 3,980,845 | 9/1976 | Gryctko et al. | 200/50 A |

*Primary Examiner*—J. R. Scott

*Attorney, Agent, or Firm*—A. Sidney Johnston; Richard T. Guttman

[57] ABSTRACT

A circuit breaker operating apparatus is of the type having an enclosure, the circuit breaker mounted inside the enclosure, the circuit breaker has an operating toggle, the operating toggle has at least a trip position into which trip position the toggle is urged when the circuit breaker goes into a trip condition, the apparatus has a handle mounted on the exterior of the enclosure, the handle has a lever mounted for rotational motion relative to the enclosure. A guide is fixedly attached to the handle; a cam link, the cam link having a first end rotatably attached to the lever, and the cam link having a second end slidably attached to the guide so that as the lever undergoes rotation the second end of the cam link moves along the guide. A pin allows the second end of the cam link to slide along the guide in response to the toggle as the toggle is urged into the trip position by the circuit breaker going into a trip condition so that the position of the lever indicates that the circuit breaker is in a trip condition.

14 Claims, 16 Drawing Figures

CIRCUIT BREAKER

TRIP INDICATING OPERATING HANDLE

TRIP INDICATING CIRCUIT BREAKER OPERATING HANDLE

FIELD OF THE INVENTION

This invention relates to circuit breaker operating handles, and more particularly to handles mounted on the exterior of an enclosure surrounding the circuit breaker.

BACKGROUND OF THE INVENTION

A problem with circuit breaker operating handles which are mounted on the exterior of an enclosure surrounding the circuit breaker is that the handle position does not indicate a trip condition of the circuit breaker. Handles have, in the past, required more force to effect their motion than can be delivered by a circuit breaker toggle. In normal operation, a circuit breaker toggle moves into a trip position when the circuit breaker goes into a trip condition. However, the circuit breaker will trip even though the toggle is restrained from moving into the trip position. The toggle exerts a force on any resisting mechanism. Operating handles have required more force to move the handle than can be exerted by the toggle of a typical circuit breaker.

Circuit breaker operating handles mounted on the exterior of an enclosure surrounding the circuit breaker are illustrated in U.S. Pat. No. 3,475,576, issued to Bugni, et al., on Oct. 28, 1969, and 3,207,880, issued to Mekelburg, on Sept. 21, 1965, and 3,059,072, issued to Mekelburg, et al., on Oct. 16, 1962. A disadvantage of the operating handles illustrated in these U.S. patents is that all require too much force for the toggle of the circuit breaker to move the handle into a trip indicating position.

SUMMARY OF THE INVENTION

The invention is a circuit breaker operating apparatus which can move a hand lever into a trip indicating position by action of the circuit breaker toggle. The hand lever is mounted on the exterior of an enclosure surrounding the circuit breaker.

The invention is a circuit breaker operating apparatus of the type having an enclosure, the circuit breaker is mounted inside the enclosure, the circuit breaker has an operating toggle, the operating toggle has at least a trip position into which trip position the toggle is urged when the circuit breaker goes into a trip condition, the apparatus has a handle mounted on the exterior of the enclosure, the handle has a lever mounted for rotational motion relative to the enclosure. The invention has a guide fixedly attached to the handle; a cam link, the cam link having a first end rotatably attached to the lever, and the cam link having a second end slidably attached to the guide so that as the lever undergoes rotation the second end of the cam link moves along the guide; means for sliding the second end of the cam link along the guide in response to the toggle as the toggle is urged into the trip position by the circuit breaker going into a trip condition so that the position of the lever indicates that the circuit breaker is in a trip condition.

Other and further aspects of the present invention will become apparent during the course of the following description and by reference to the accompanying drawings.

BRIEF DESCRIPTION OF THE DRAWINGS

Referring now to the drawings, in which like numerals represent like parts in the several views.

DETAILED DESCRIPTION

Figure 1A:
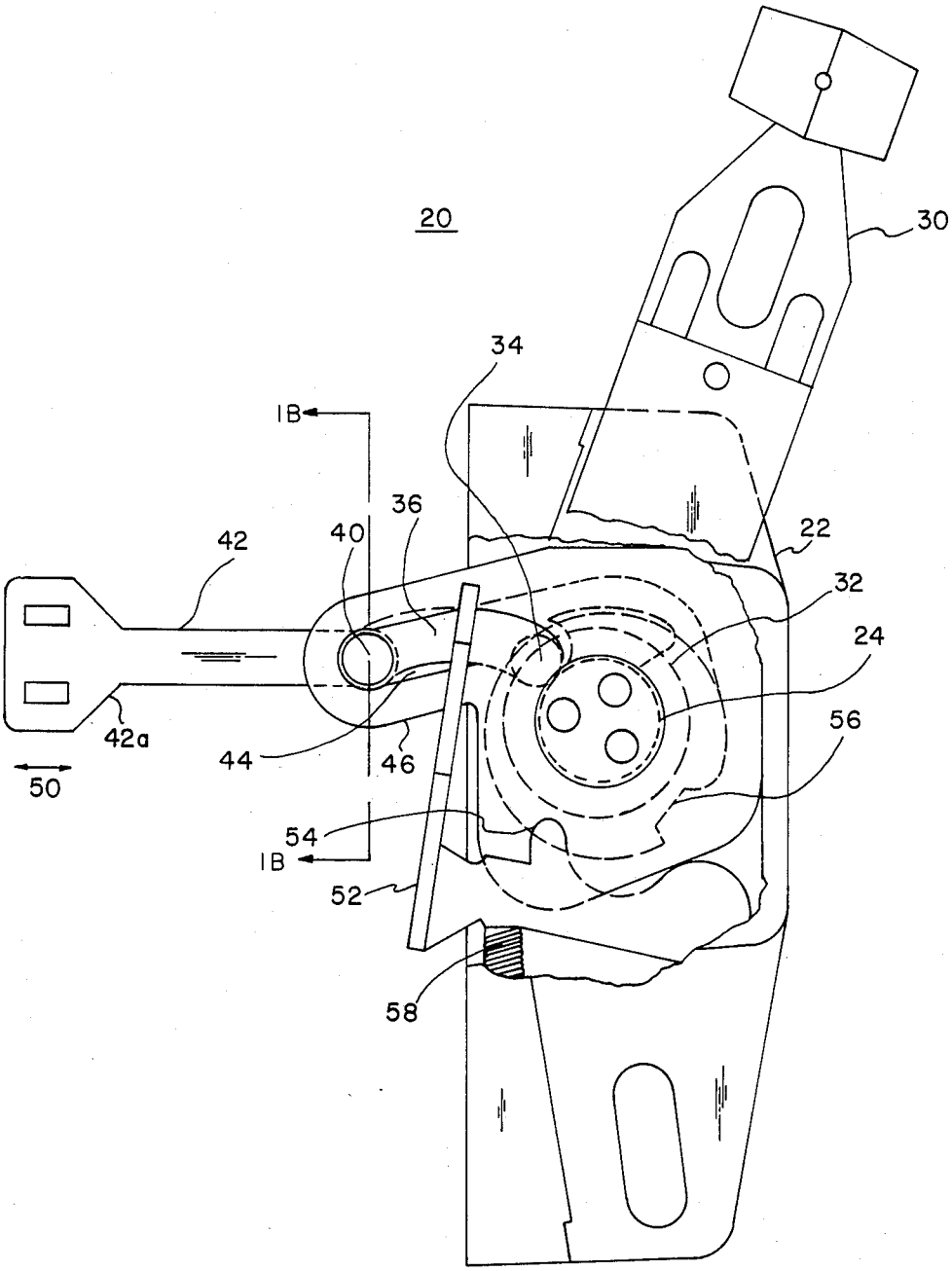
FIG. 1A is a side view, in cutaway, of a circuit breaker operating handle.

FIG. 1A shows a circuit breaker operating handle 20. Housing 22 of the circuit breaker operating handle 20 is shown in partial cutaway. A bearing 24 is mounted for rotational motion within housing 22. Hand lever 30 is fixedly attached to bearing 24, and so hand lever 30 may be pivoted about bearing 24, thereby causing bearing 24 to undergo rotational motion. Cam 32 is rigidly attached to hand lever 30 and bearing 24, so that as hand lever 30 is pivoted, causing rotational motion of bearing 24, then cam 32 undergoes rotational motion. Handle pin 34 is mounted in a hole in cam 32. Handle pin 34 also passes through a hole in cam link 36. Cam link 36 is free to rotate about handle pin 34. Linkage pin 40 passes through a hole in cam link 36. Also, linkage pin 40 is slidably restrained to move in slot 44 of guide 46. Further, linkage pin 40 passes through a hole in connecting link 42, and connecting link 42 is free to rotate about linkage pin 40. Guide 46 is fixedly attached to housing 22.

As hand lever 30 is pivoted about bearing 24, cam link 36 rotates about handle pin 34. However, linkage pin 40 is constrained to slidably move within slot 44. As linkage pin 40 slides within slot 44 and hand lever 30 is pivoted about bearing 24, then cam link 36 is forced to rotate about handle pin 34. Connecting link 42 is caused to move left and/or right as shown by arrows 50 when hand lever 30 is pivoted about bearing 24. Pivotal motion of hand lever 30 therefore causes linkage pin 40 to move back and forth in slot 44. Alternatively, force applied to end **42*a* of connecting link 42 causes linkage pin 40 to slide in slot 44, and also causes hand lever 30 to pivot about bearing 24**.

Interlock lever 52 has a pawl 54 which engages cutout 56 attached to cam 32, thereby preventing rotation of cam 32, thereby preventing pivotal motion of hand lever 30. Interlock lever 52 is urged upward by spring 58 in order to positively engage pawl 54 in cutout 56. Interlock lever 52 may be urged into a lower position by compression of spring 58 in order to disengage pawl 54 from cutout 56, thereby releasing hand lever 30 for pivotal motion about bearing 24. Interlock lever 52 is used to prevent turning a circuit breaker on when the door to an enclosure surrounding the circuit breaker is open, as a safety measure. A bracket on the door of the enclosure depresses interlock lever 52, thereby disengaging pawl 54 from cutout 56 when the door is closed.

Figure 1B:
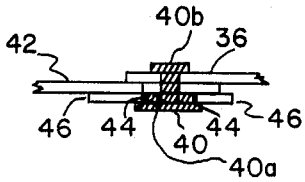
FIG. 1B is a sectional view along section 1B—1B of FIG. 1A.

FIG. 1B is a cross-section through section 1B—1B of FIG. 1A. In FIG. 1B linkage pin 40 is shown in enlarged cross-section. Step 40*a* of linkage pin 40 rides in slot 44 of guide 46. Cam link 36 and connecting link 42 are held in place by flattened end 40*b* of linkage pin 40. Step 40*a* of linkage pin 40 provides a slidable surface in slot 44 of guide 46.

Figure 2A:
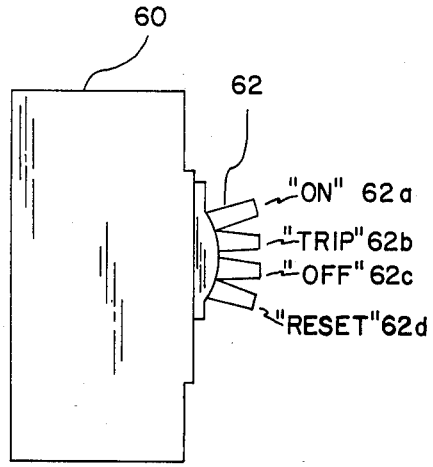
FIG. 2A and FIG. 2B are a side view showing an operating handle and a circuit breaker in various positions.
Figure 2B:
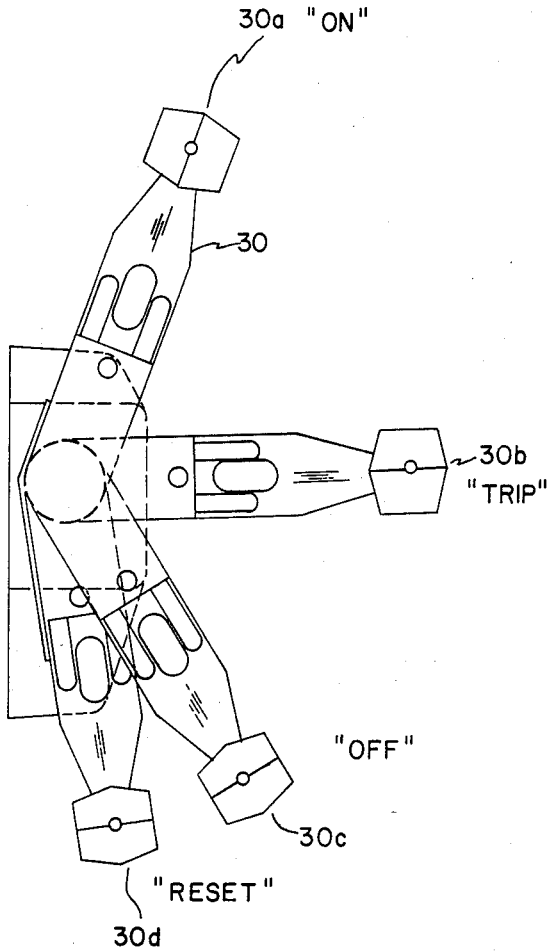

FIG. 2A and FIG. 2B show circuit breaker 60 having an operating toggle in four different positions 62*a*, 62*b*, 62*c*, 62*d*, and also a circuit breaker operating handle 20 having the hand lever 30 in four positions, 30*a*, 30*b*, 30*c*, 30*d*, corresponding to the positions of toggle 62. A circuit breaker, in normal operation, has a toggle which operates the circuit breaker. Operation of the circuit breaker may be described by beginning with the toggle in the "off" position 62*c*. Normally the circuit breaker is turned on by moving the toggle into the "on" position 62*a*. If a current surge, or other event, trips the circuit breaker, the toggle moves into a "trip" position 62*b*. In a trip condition current flow within the circuit breaker is interrupted, thereby protecting electrical apparatus connected to the circuit breaker. In order to turn the circuit breaker on again, the toggle must be moved into the "reset" position 62*d*, and then moved into the "on" position 62*a*.

The operation of handle 20 may be discussed beginning with hand lever 30 in the "off" position 30*c*. The circuit breaker is turned on by moving handle 30 from the "off" position 30*c* into the "on" position 30*a*, and a mechanical linkage between hand lever 30 moves toggle 62 from the "off" position 62*c* into the "on" position 62*a*. When an electric current surge, or other event, causes the circuit breaker to trip, the toggle 62 moves from the "on" position 62*a* into the "trip" position 62*b*, and in so doing applies force to the mechanical linkage of hand lever 30, causing hand lever 30 to move into trip position 30*b*. The circuit breaker 60 may then be turned on by a person: first by moving hand lever 30 from the "trip" position 30*b* into the "reset" position 30*d*, and in so doing the mechanical linkage causes toggle 62 to move into "reset" position 62*d*; and second by moving hand lever 30 into the "on" position 30*a*, and the mechanical linkage correspondingly moves the toggle into the "on" position 62*a*, completing the "turn on" cycle of the circuit breaker.

Figure 3:
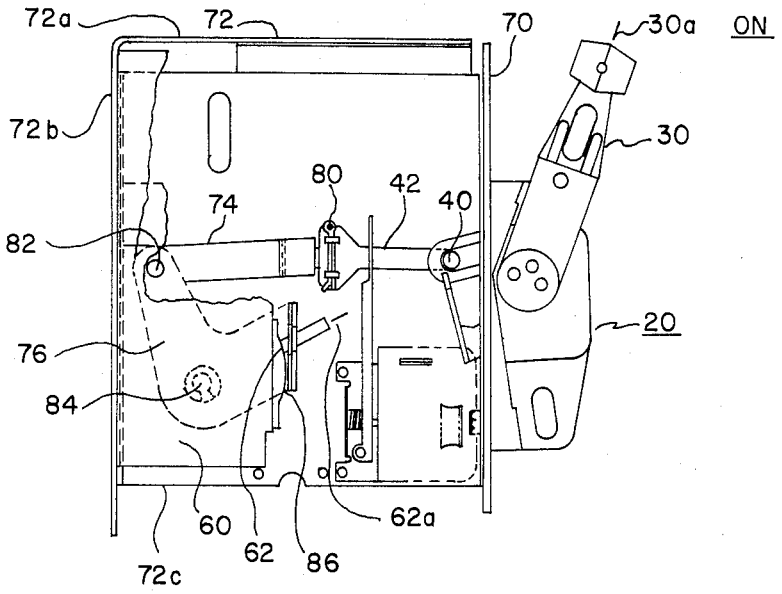
FIGS. 3, 4 and 5 are side views showing handle and toggle mechanical connections in an enclosure.
Figure 4:
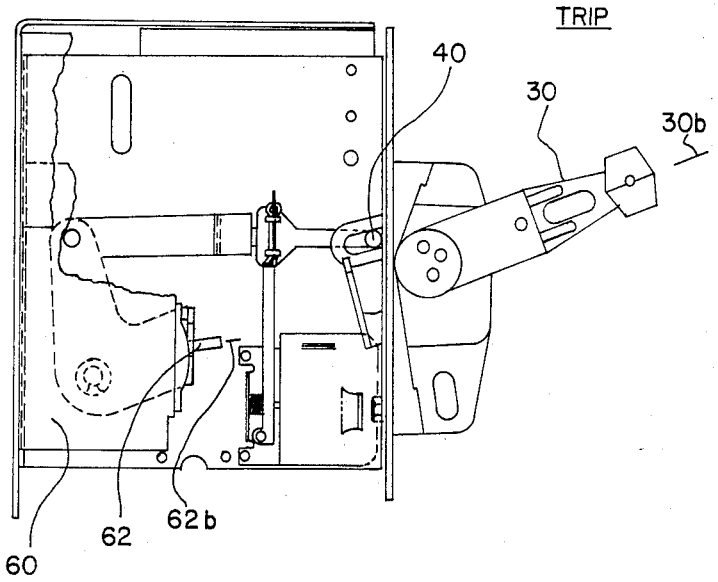
Figure 5:
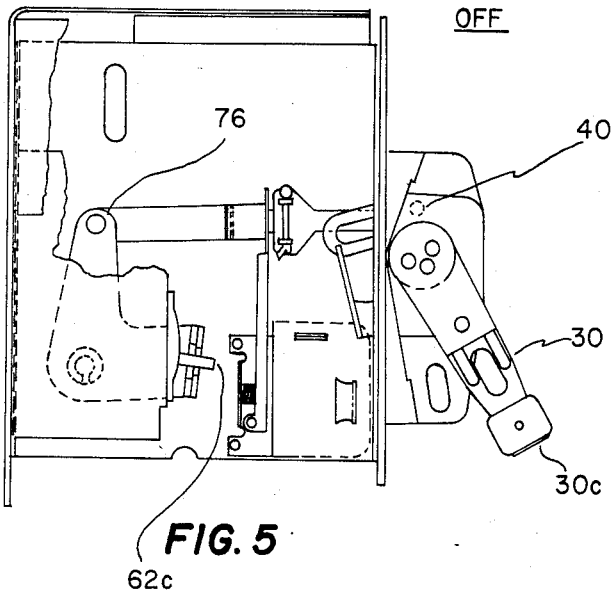

FIGS. 3, 4, and 5 show a side view of a circuit breaker operating handle 20 mounted on the front face 70 of an enclosure 72. A frame for mounting the parts of the apparatus is formed by the top 72*a*, back 72*b*, bottom 72*c*, front 70, and ends 72*d*, and 72*e* shown in FIGS. 6 and 7. Also, connecting link 42 is attached to a control rod 74, and control rod 74 is attached to an operating bail 76. Connecting link 42 is attached by cotter pin 80 to control rod 74. Control rod 74 is attached by a pivotal attachment 82 to operating bail 76. Operating bail 76 pivots about axle 84. Operating bail 76 is attached by plate 86 to toggle 62 of circuit breaker 60.

Figure 6:
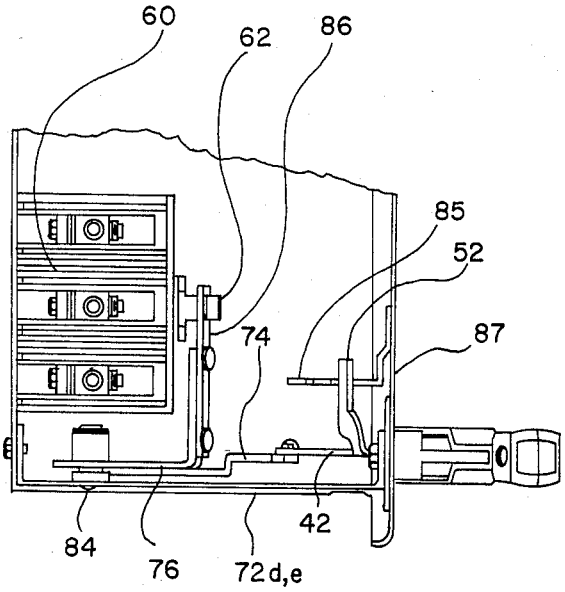
FIG. 6 is a bottom view showing handle and toggle mechanical connections in an enclosure.

FIG. 6 is a bottom view of the apparatus shown in FIGS. 3, 4, and 5, and more clearly shows axle 84, plate 86, and the connection between connecting link 42 and control rod 74. FIG. 6 also shows the connection between plate 86 and toggle 62. Bracket 85 depresses interlock lever 52 when door 87 is closed, as illustrated in FIG. 6.

FIG. 3 shows hand lever 30 in the "on" position, linkage pin 40 in the "on" position in guide 46, and toggle 62 in the "on" position 62*a*.

When a current surge, or other event causes circuit breaker 60 to trip, the internal mechanism (not shown) of circuit breaker 60 causes the toggle to move into the trip position 62*b*, as shown in FIG. 4. Toggle 62 applies force to operating bail 76, and operating bail 76 applies force to control rod 74, which in turn applies force to end 42*a* of connecting link 42. Connecting link 42 then causes linkage pin 40 to slide within slot 44 of guide 46. Linkage pin 40 then moves into the trip position as shown in FIG. 4. Hand lever 30 is then forced into the "trip" position by action of cam link 36. Hand lever 30 is shown in "trip" position 30*b* in FIG. 4.

After circuit breaker 60 goes into trip condition and hand lever 30 goes into the trip indicating position 30*d*, then a person normally moves hand lever 30 into the "off" position 30*c*, as shown in FIG. 5. Hand lever 30 is then normally moved into the "reset" position 30*d*, moving toggle 62 into the "reset" position 62*d*, and the circuit breaker then is turned on by moving hand lever 30 into the "on" position 30*a*. When hand lever 30 is moved into the "on" position 30*a*, the mechanical linkage comprising cam link 36, guide 46, connecting link 42, control rod 74, and operating bail 76, move toggle 62 into the "on" position 62*a*.

Figure 7:
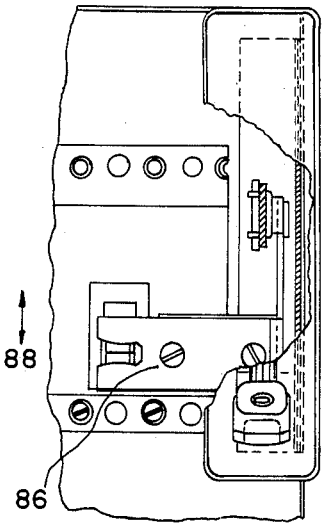
FIG. 7 is a front view, in partial cutaway, of a circuit breaker operating handle mounted on the outside of an enclosure.

FIG. 7 is a front view of the apparatus shown in FIGS. 3, 4, 5, and 6, and shows more clearly plate 86. Plate 86 moves in the directions shown by arrows 88 during operation of the apparatus. In moving in the direction shown by arrow 88, plate 86 moves toggle 62 into the various toggle positions 62*a*, 62*b*, 62*c*, and 62*d*.

Figure 8:
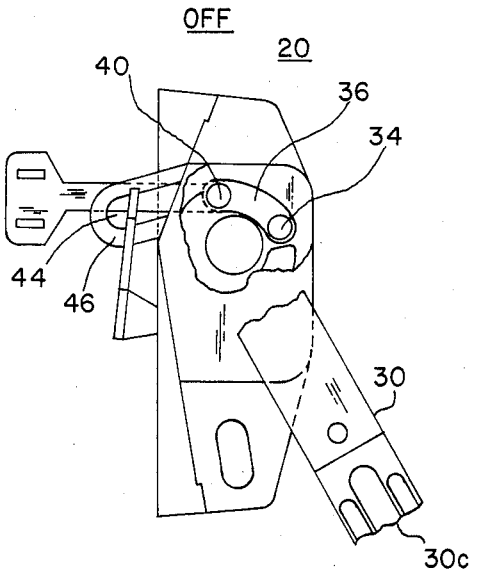
FIGS. 8, 9, 10 and 11 are side views, in cutaway, showing a circuit breaker operating handle mechanism.
Figure 9:
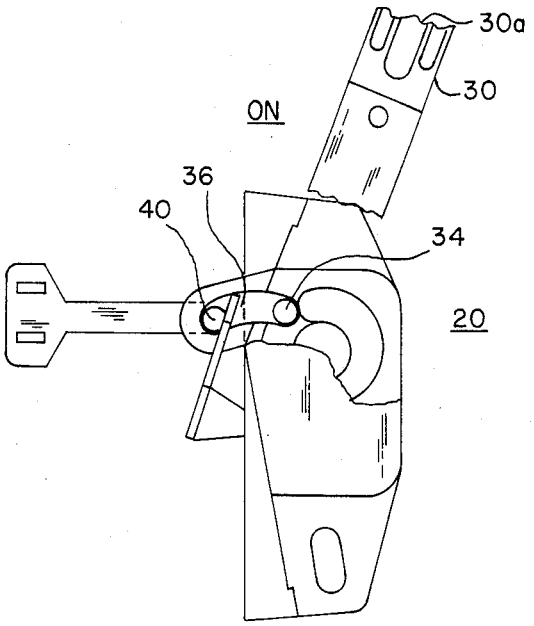

FIGS. 8, 9, 10, and 11 show motion of cam link 36, handle pin 34, and linkage pin 40, with respect to guide 46 and slot 44, during operation of the circuit breaker operating handle 20. FIG. 8 shows operating handle 20 in the "off" position 30*c*, and cam link 36, along with handle pin 34 and linkage pin 40 in the corresponding "off" position. FIG. 9 shows hand lever 30 in the "on" position 30*a*. Linkage pin 40 is shown in FIG. 9 to be in the extended position, corresponding to the "on" position, of circuit breaker 60.

Figure 10:
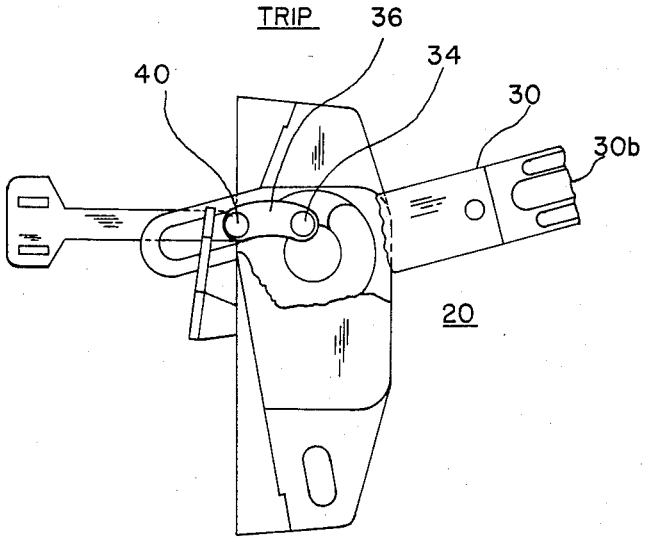

FIG. 10 shows hand lever 30 in the "trip" position 30*b*. Linkage pin 40 is shown to be in the corresponding position in slot 44 of guide 46 for the trip position of the circuit breaker operating hand lever 30.

Figure 11:
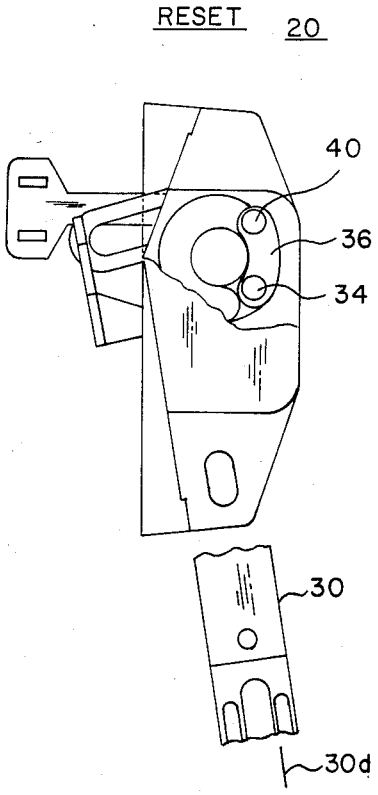

FIG. 11 shows hand lever 30 in the "reset" position 30*d*. Linkage pin 40 is shown to be in the position corresponding to reset, in slot 44 of guide 46.

Also cam link 36 is shown in its corresponding positions in FIGS. 8, 9, 10, and 11. The important motion of cam link 36 is the linear motion of linkage pin 40 in slot 44 of guide 46 as hand lever 30 is pivoted about bearing 24. As hand lever 30 is pivoted about bearing 24, cam link 36 rotates about handle pin 34, as shown in FIGS. 8, 9, 10, and 11. Pivotal motion of hand lever 30 about bearing 24 causes both rotation of cam 32, and the motions of cam link 36 between the "off", "on", "trip" and "reset" positions.

Figure 12:
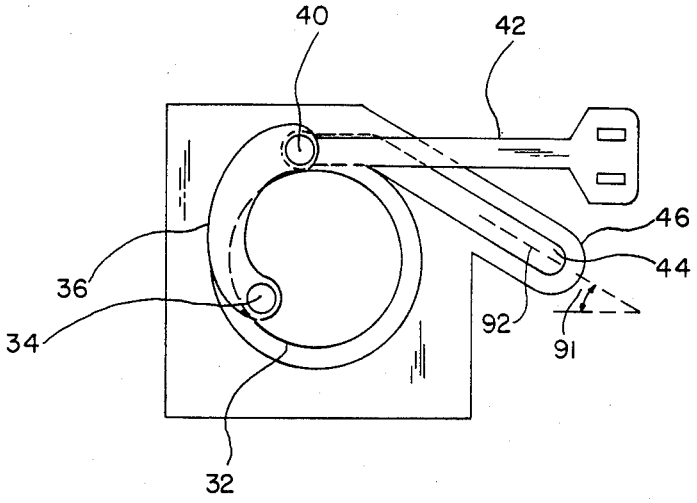
FIGS. 12 and 13 are side views of a guide and cam link.
Figure 13:
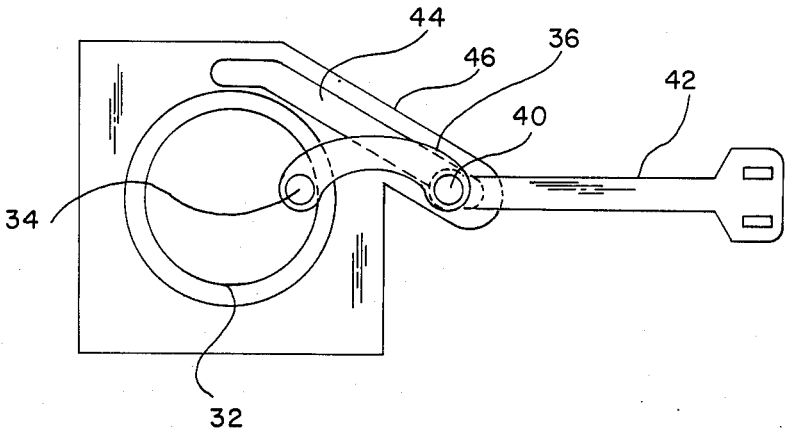

FIGS. 12 and 13 show guide 46 removed from circuit breaker operating handle 20. FIG. 12 shows cam link 36 near the "off" or "reset" positions. FIG. 13 shows cam link 36 near the "on" position. Rotation of cam link 36 about handle pin 34, and also rotation about linkage pin 40 is clearly illustrated in FIGS. 12 and 13. Also linear motion of linkage pin 40 in slot 44 of guide 46 as cam 32 undergoes rotational motion is illustrated in FIGS. 12 and 13.

Angle 91 between the centerline 92 of slot 44 of guide 46 and the horizontal may be chosen for convenience. It may be necessary to select a specific value of angle 91 in order to match handle 20 of the invention to existing circuit breaker enclosures. Because of the linear motion linkage pin 40 undergoes within slot 44 of guide 46 during pivotal motion of hand lever 30, a range of values of angle 91 are available to the designer in order to obtain mechanical matching to existing circuit breaker enclosures originally designed for use with older style handles. Such older style handles are illustrated, for example, in U.S. Pat. Nos. 3,475,576, and 3,207,880, and 3,059,072, as discussed hereinabove.

Figure 14:
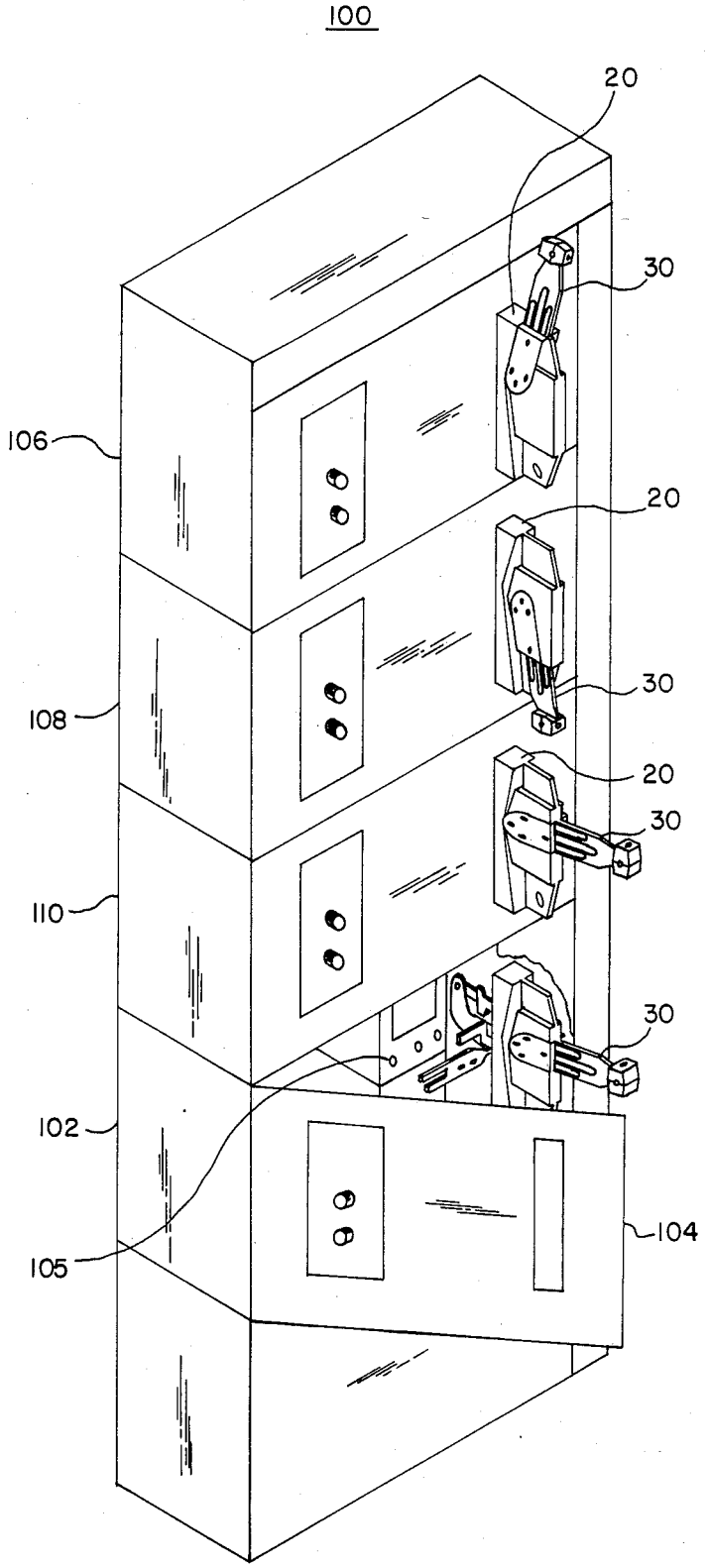
FIG. 14 is an isometric view of a control center showing operating handles.

FIG. 14 shows a control center 100 for control of several circuit breakers. Each circuit breaker is in a separate enclosure. Enclosure 102 has door 104 standing open, and circuit breaker 105 is visible inside the enclosure. Enclosure 106 shows circuit breaker operating handle 20 having hand lever 30 in the "on" position. The circuit breaker (not shown) associated with enclosure 106 is therefore in the "on" condition.

Enclosure 108 shows circuit breaker operating handle 20 having hand lever 30 in the "off" position. The circuit breaker (not shown) inside enclosure 108 is therefore in the "off" condition.

Enclosure 110 shows circuit breaker operating handle 20 having hand lever 30 in the "trip" position. The circuit breaker (not shown) inside enclosure 110 is therefore in the trip condition.

Enclosure 102 shows the circuit breaker operating handle 20 having hand lever 30 in the "trip" position. Door 104 is shown standing open and there is illustrated the mechanical linkage between circuit breaker operating handle 20 and circuit breaker 60, as shown in greater detail in FIGS. 3, 4, 5, 6 and 7.

It is to be understood that the above-described embodiments are simply illustrative of the principles of the invention. Various other modifications and changes may be made by those skilled in the art which will embody the principles of the invention and fall within the spirit and scope thereof.

What is claimed is:

1. A circuit breaker operating apparatus, said apparatus of the type having an enclosure, said circuit breaker mounted inside said enclosure, said circuit breaker having an operating toggle, said operating toggle having at least a trip position into which trip position said toggle is urged when said circuit breaker goes into a trip condition, said apparatus having a handle mounted on the exterior of said enclosure, said handle having a lever mounted for rotational motion relative to said enclosure, comprising:

a guide fixedly attached to said handle;

a cam link, said cam link having a first end rotatably attached to said lever, and said cam link having a second end slidably attached to said guide so that as said lever undergoes rotation said second end of said cam link moves along said guide;

means for sliding said second end of said cam link along said guide in response to said toggle as said toggle is urged into said trip position by said circuit breaker going into a trip condition so that the position of said lever indicates that said circuit breaker is in a trip condition.

2. The apparatus as in claim 1 wherein said means for sliding said second end of said cam link along said guide comprises an operating bail.

3. The apparatus as in claim 1 wherein said lever is a hand lever mechanically linked to said toggle for operation of said circuit breaker.

4. The apparatus as in claim 1 further comprising:

a connecting link rotatably attached at a first end to said second end of said cam link, and having two holes in a second end;

a control rod having two projections for matingly fitting into said two holes in said second end of said connecting link, and said control rod having a hole in a second end;

a cotter pin passing through holes in said projections of said control rod in order to attach said control rod to said connecting link; and, an operating bail pivotally mounted near its midpoint, having a rivet in a first end for slidably passing through said hole in said second end of said control rod in order to provide a rotatable connection between said operating bail and said control rod, and having a slot in a second end through which said toggle of said circuit breaker passes, so that when said lever undergoes said rotational motion then said second end of said cam link slides along said guide, and said cam link imparts a linear component of motion to said connecting link, thereby causing rotation of said operating bail about a pivot so as to operate said toggle of said circuit breaker.

5. The apparatus as in claim 1 further comprising:

a pivotally mounted operating bail having a hole in a toggle end through which said toggle of said circuit breaker extends, having a second end having a hole therein; and, a mechanical linkage rotatably attached to said hole in said second end of said operating bail at a first end of said mechanical linkage, and a second end of said mechanical linkage rotatably attached to said second end of said cam link, so that motion of said toggle by action of said circuit breaker may cause rotation of said bail arm about its pivot and said mechanical linkage transmits motion of said bail arm to move said lever into a "trip indicating" position.

6. A circuit breaker operating apparatus, said apparatus of the type having an enclosure, said circuit breaker mounted inside said enclosure, said circuit breaker having an operating toggle, said operating toggle having an "off" position, an "on" position, a "trip" position, and a "reset" position, said apparatus having a handle mounted on the exterior of said enclosure, said handle having a hand lever mounted for rotational motion relative to said enclosure, comprising:

a guide fixedly attached to said handle;

a cam link, said cam link having a first end rotatably attached to said hand lever, and said cam link having a second end slidably attached to said guide so that as said handle is pivoted said second end of said cam link moves along said guide; and, an operating bail moveably linked to said second end of said cam link, and said operating bail also moveably linked to said toggle of said circuit breaker so that as said hand lever is pivoted into a first position said toggle is moved into said "off" position, as said hand lever is pivoted into a second position said toggle is moved into said "on" position, as said hand lever is pivoted into a third position said toggle is moved into said "reset" position, and as said toggle is urged into said "trip" position as a result of said circuit breaker going into a trip condition then said hand lever is pivoted into a fourth position by action of said toggle as an indication that said circuit breaker is in said trip condition.

7. A circuit breaker operating apparatus comprising:

a frame;

a circuit breaker fixedly mounted to said frame, said circuit breaker having an operating toggle, said operating toggle having an "off" position, an "on" position, a "trip" position, and a "reset" position;

a hand lever having pivotal motion about a bearing, said hand lever mounted for rotation relative to said frame;

a guide fixedly attached to said handle;

a cam link, said cam link having a first end rotatably attached to said hand lever, and said cam link having a second end slidably attached to said guide so that as said handle is pivoted said second end of said cam link moves along said guide; and, an operating bail moveably linked to said second end of said cam link, and said operating bail also moveably linked to said toggle of said circuit breaker so that as said hand lever is pivoted into a first position said toggle is moved into said "off" position, as said hand lever is pivoted into a second position said toggle is moved into said "on" position, as said hand lever is pivoted into a third position said toggle is moved into said "reset" position, and as said toggle is urged into said "trip" position as a result of said circuit breaker going into a trip condition then said hand lever is pivoted into a fourth position by action of said toggle as an indication that said circuit breaker is in said trip condition.

8. The apparatus as in claim 7 wherein said operating bail is mounted by a pivot to said frame for rotational motion relative to said frame, and is slidably attached to said toggle of said circuit breaker.

9. The apparatus as in claim 8 further comprising a connecting link rotatably attached to said cam link and linked to said operating bail so as to cause rotation of said bail about said pivot.

10. The apparatus as in claim 9 further comprising a pin slidably mounted in said guide, said pin providing said slidable attachment of said second end of said cam link to said guide, and said pin also providing said rotatable attachment of said connecting link to said cam link.

11. The apparatus as in claim 10 further comprising a control rod rotatably attached to said connecting link and rotatably linked to said operating bail.

12. The apparatus as in claim 11 further comprising a cotter pin for attaching said connecting link to said control rod.

13. The apparatus as in claim 7 further comprising a cam rigidly attached to said hand lever, and said cam providing said rotatable attachment of said first end of said cam link to said hand lever.

14. The apparatus as in claim 7 further comprising an enclosure surrounding said circuit breaker, and said hand lever being mounted on the exterior of said enclosure.

* * * * *